US005615919A

United States Patent [19]

Ivey

[11] Patent Number: 5,615,919

[45] Date of Patent: Apr. 1, 1997

[54] DEADBOLT EXTENDER

[76] Inventor: Brandon C. Ivey, 4587 Shady Oaks La., Edgewater, Fla. 32141

[21] Appl. No.: 537,587

[22] Filed: Sep. 28, 1995

[51] Int. Cl.[6] ..... E05B 63/20

[52] U.S. Cl. ..... 292/332; 292/164; 292/335

[58] Field of Search ..... 292/335, 332, 292/164, 170

[56] References Cited

U.S. PATENT DOCUMENTS

| | | | |
|---|---|---|---|
| 1,393,911 | 10/1921 | Schumaker | 292/335 |
| 3,603,630 | 9/1971 | Check . | |
| 3,621,686 | 11/1971 | Klein | 292/335 X |
| 4,561,684 | 12/1985 | Marotto . | |
| 5,044,182 | 9/1991 | Totten . | |
| 5,058,940 | 10/1991 | Hart . | |
| 5,177,988 | 1/1993 | Bushnell . | |
| 5,263,347 | 11/1993 | Allbaugh et al. . | |
| 5,386,713 | 2/1995 | Wilson . | |

FOREIGN PATENT DOCUMENTS

| | | | |
|---|---|---|---|
| 1016319 | 7/1952 | France | 292/335 |

*Primary Examiner*—Rodney M. Lindsey
*Attorney, Agent, or Firm*—Paul S. Rooy

[57] ABSTRACT

A deadbolt extender which automatically extends a deadbolt when the door upon which it is mounted is closed. The deadbolt extender comprises a tongue body reciprocating within a tongue body track, a deadbolt reciprocating within a deadbolt track, and a release mechanism releasably engaged with the tongue body. A tongue attached to the tongue body retractably engages a spring-loaded deadbolt latch. The tongue body track diverges from the deadbolt track, so that when the tongue body is at an extension end of the tongue body track, the tongue is retracted out of the way, and the deadbolt may be operated conventionally, using a conventional deadbolt drive mechanism. The deadbolt extender will not extend the deadbolt automatically upon door closure unless first cocked, thereby eliminating unwanted "lockouts".

12 Claims, 5 Drawing Sheets

DEADBOLT EXTENDER

BACKGROUND OF THE INVENTION

1. Field of the Invention

This invention relates to deadbolt locks, and in particular to a deadbolt extender.

2. Background of the Invention

Deadbolt locks provide security in locking doors by virtue of the solidity of their construction. Typically, a deadbolt is a solid bar of strong material, such as iron, which slides from a housing mounted on or in a door to be locked, into a strike plate aperture. Generally, the deadbolt is actuated either by a key (from the inside or the outside of the door) or by a handle (inside the door).

Although deadbolts provide greater security than most latches, a problem associated with their use is when an individual exits a door to be deadbolted, the individual must locate a key, insert it into the outside deadbolt lock keyhole, turn the key in order to extend the deadbolt into the locked position, and then put away the key. This series of operations is tedious and time-consuming. And if the occupant is carrying anything requiring two hands, these operations are inconvenient or impossible to accomplish without putting the items being carried down, extending the deadbolt with a key, and then picking the items up again.

Another problem with existing deadbolt designs is that the inconvenience of key-actuating the deadbolt lock may dissuade its use. With the current elevated crime rates in many areas, non-use of deadbolts may facilitate burglaries.

EXISTING DESIGNS

A number of patents have been granted for automatic deadbolt actuators. Totten was granted U.S. Pat. No. 5,044,182 for an Automatic Deadbolt which combined a latch and an automatic deadbolt. This invention extended an integral latch/deadbolt farther into a strike plate opening upon door closure. Disadvantages associated with this design include complexity, and the requirement that the latch be of integral construction with the deadbolt. This means that the only latch design which may be used with this invention is the integral latch/deadbolt taught in the patent. In addition, the end configuration taught is a wedge (required for the latching function), which is inherently less jimmy-proof than the rectangular bar configuration of traditional deadbolts.

Marrotto was granted U.S. Pat. No. 4,561,684 for an Automatic Deadbolt which extended when the door upon which it was mounted was closed. There were a number of problems with this design. First, the deadbolt release mechanism depended upon a cam surface sliding over a plate opening in order to force the plate downwards out of engagement with a deadbolt notch. The deadbolt notch was held against the plate by means of a spring. Therefore, the cam surface could tend to wear due to the friction between the cam surface and the plate opening.

In addition, this deadbolt would always deploy upon door closure, unless the deadbolt were first retracted, the door opened, and an auxiliary catch engaged, which was accessible only when the door upon which the Automatic Deadbolt was mounted was open. Thus the normal operation of this deadbolt was to extend every time the door closed. In most door closures it is not desired to deadbolt the door (for example, when one egresses a residence to check the mail, pick up the newspaper, work in the yard, etc.). One reason for this is the necessity of a key to re-enter. Here, for example, unless the Automatic Deadbolt were disabled, the bathrobe-clad homeowner briefly exiting his residence to pick up the morning paper would be automatically deadbolted out of his home with the slamming of the door. This could result in inconvenience and expensive locksmith bills.

Hart and Check were granted U.S. Pat. Nos. 5,058,940 and 3,603,630 respectively for combination latches and deadbolts. Both these patents taught integral latches/deadbolts. These designs suffered from a number of disadvantages. First, only the latch integral to the deadbolt was taught to be usable with the deadbolt. Also, both designs taught a wedge-shaped deadbolt end configuration, which is inherently less jimmy-proof than the rectangular bar configuration of traditional deadbolts.

A number of patents have been granted for remote control deadbolts for use with cars. These deadbolts were typically solenoid or hydraulically actuated, and required the incorporation of a radio transmitter and receiver.

SUMMARY OF THE INVENTION

Accordingly, it is an object of the present invention to provide a deadbolt extender which automatically extends a deadbolt into a strike plate aperture upon door closure. Design features allowing this object to be accomplished include a tongue body reciprocating within a tongue body track, a tongue body spring, a tongue in contact with a deadbolt latch, and a deadbolt reciprocating within a deadbolt track. Advantages associated with the accomplishment of this object include increased convenience and security.

It is another object of the present invention to provide a deadbolt extender which features all controls on the inside of the door on which it is mounted. Design features allowing this object to be accomplished include a tongue which is out of contact with a deadbolt latch unless the deadbolt extender is cocked, and a tongue stem which extends through the inside of the door. Benefits associated with the accomplishment of this object is increased security and convenience of operation.

It is another object of this invention to provide a deadbolt extender which will not operate unless cocked. Design features enabling the accomplishment of this object include a tongue stem, a Y, and a catch. Advantages associated with the realization of this object include the elimination of inconvenient, unwanted deadbolt extensions, and consequent reduction of the chances of being locked out.

It is still another object of this invention to provide a deadbolt extender which may be installed on existing doors and used with existing latch locks. Design features allowing this object to be achieved include a tongue body reciprocating within a tongue body track, and a deadbolt reciprocating within a deadbolt track. Benefits associated with reaching this objective include the ease and low cost of installation in existing doors, along with the convenience and security of automatic use when desired.

It is a further object of this invention to provide a deadbolt extender which provides for long extension travel of the deadbolt. Features permitting this object to be accomplished include a deadbolt traveling within a deadbolt track driven by a tongue connected with a tongue body spring. Benefits associated with the achievement of this object include the greater security associated with a farther (greater than 1 inch) deadbolt travel.

It is a further object of this invention to provide deadbolt extender whose deadbolt may be operated conventionally.

Features permitting this object to be accomplished include a tongue which retracts out of the way when the deadbolt extender is not cocked, and a deadbolt connected with a conventional deadbolt drive mechanism. Benefits associated with the achievement of this object include ease and familiarity of conventional use.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIGS. 2 and 3. Sheet three contains FIGS. 4 and 5. Sheet four contains FIGS. 6 and 7. Sheet five contains FIGS. 8 and 9.

DETAILED DESCRIPTION OF THE PREFERRED EMBODIMENT

Figure 1:
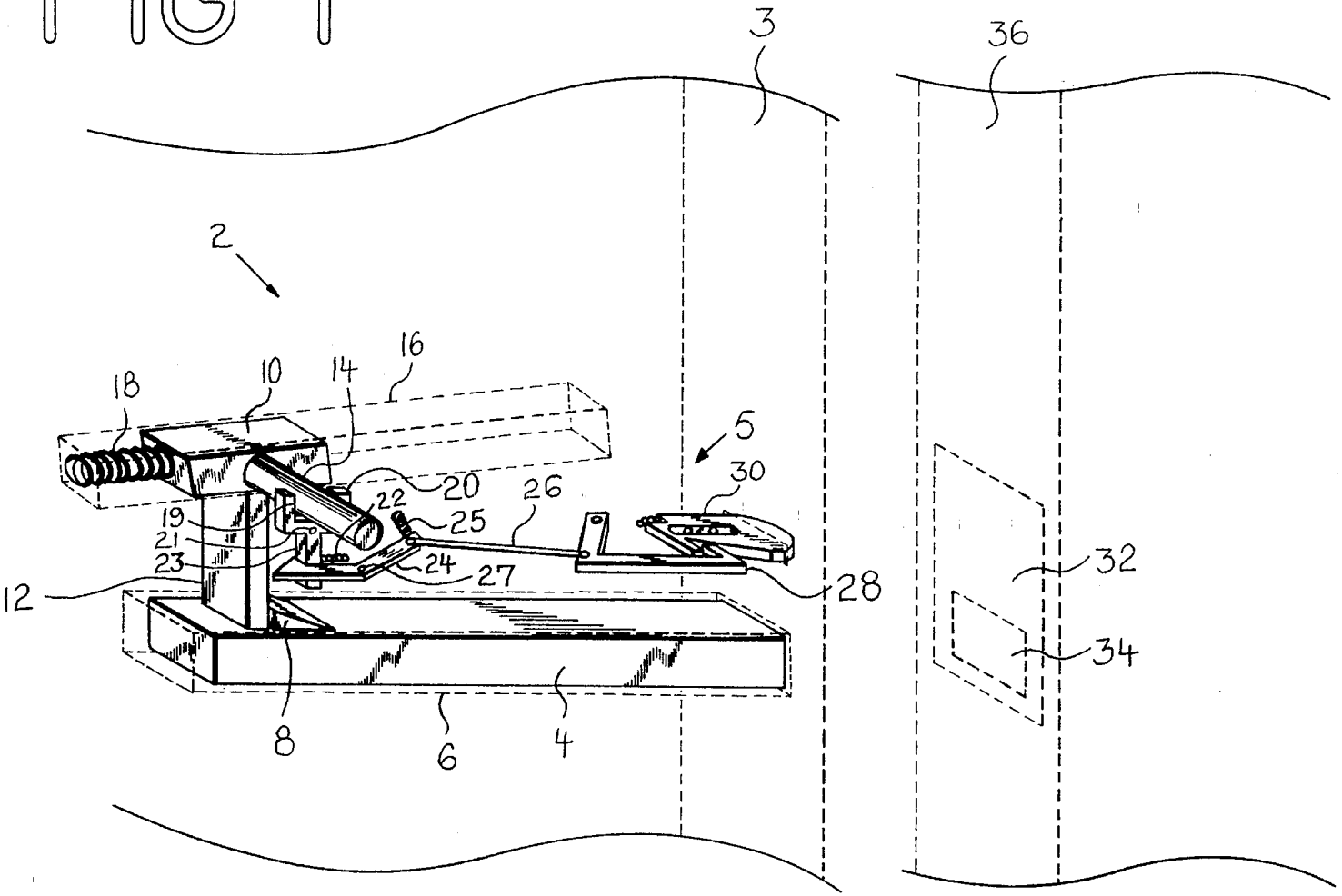
FIG. 1 is a side isometric view of a deadbolt extender in the cocked configuration.

Referring now to FIG. 1, deadbolt extender 2 is comprised generally of tongue body 10 driven by tongue body spring 18 reciprocating within tongue body track 16, deadbolt 4 reciprocating within deadbolt track 6, and release mechanism 5. Tongue 12 and tongue stem 14 are rigidly attached to tongue body 10. Tongue 12 extends deadbolt 4 by pushing against deadbolt catch 8. Tongue body track 16 and deadbolt track 6 are disposed within door 3. When extended, deadbolt 4 penetrates strike plate aperture 34 in strike plate 32. Strike plate 32 is mounted on door frame 36.

Figure 9:
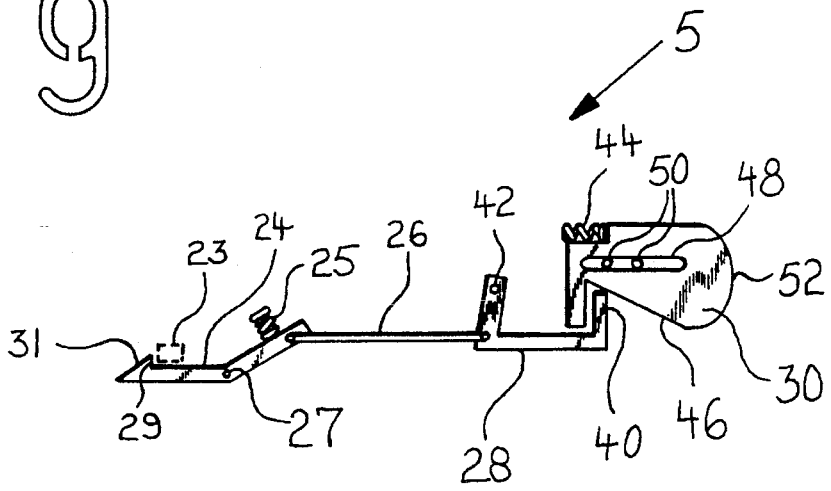
FIG. 9 is a top view of the release mechanism.

Release mechanism 5 comprises Y 20, catch 24, bellcrank 28, pushrod 26 rotatably attached to catch 24 and bellcrank 28, and release 30. Y 20 is comprised of Y cradle 19, and Y stem 23, and rotates about Y pivot point 21. Y 20 is urged to rotate in a clockwise sense by Y spring 22. Referring now also to FIG. 9, catch 24 comprises catch cam 31 and hook 29, and is free to rotate about catch pivot point 27. Catch spring 25 urges hook 29 into engagement with Y stem 23. Bellcrank 42 comprises bellcrank feeler 40, and is free to rotate about bellcrank pivot point 42.

Release 30 comprises release slot 48, release ramp 46 and release cam 52. Release 30 is free to reciprocate as constrained by pins 50 disposed within release slot 48. Release cam 52 extends through door 3 as urged by release spring 44. When door 3 is closed, however, strike plate 32 forces release 30 to translate towards catch pivot point 27.

Figure 6:
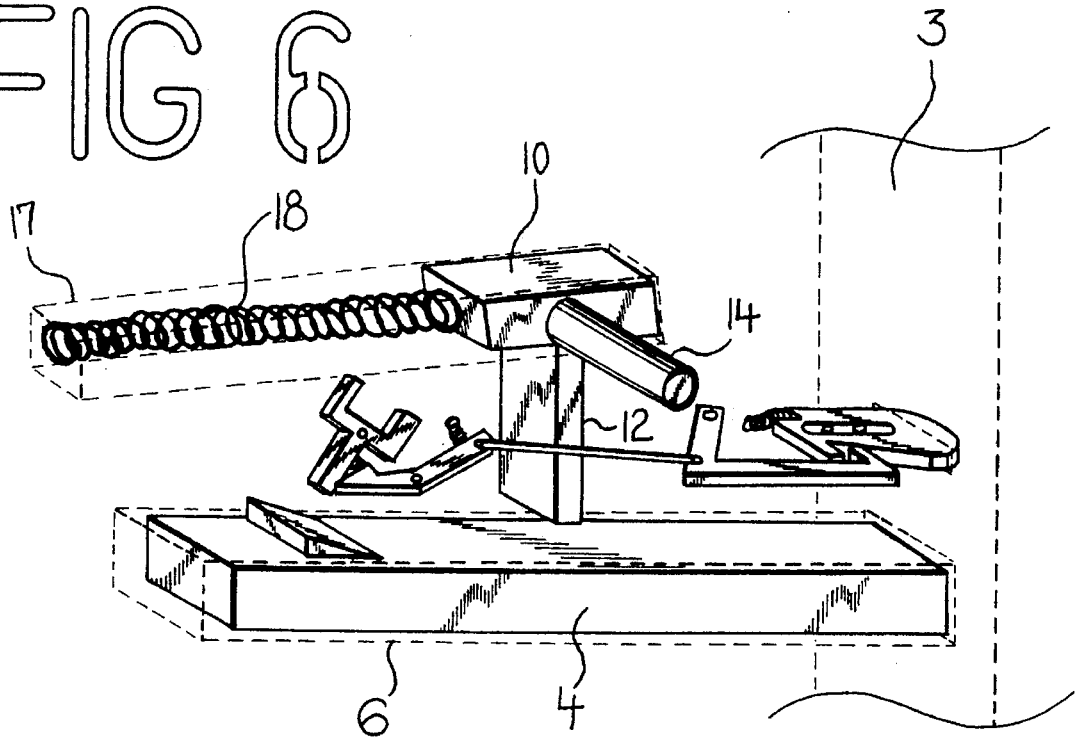
FIG. 6 is a side isometric view of a deadbolt extender whose tongue is in the retracted position and whose deadbolt has been retracted via a conventional deadbolt drive mechanism.

Deadbolt extender 2 is normally in one of two configurations: retracted (as depicted in FIG. 6) or cocked (as depicted in FIG. 1). When in the retracted configuration, deadbolt extender 2 does not automatically extend deadbolt 4 upon door closure—rather, a conventional deadbolt operating mechanism controls the position of deadbolt 4. This is because in the retracted configuration, tongue body 10 with tongue 12 attached has traveled to extension end 15 of tongue body track 16, and tongue 12 is consequently no longer engagable with deadbolt latch 8.

The automatic extension function only operates after deadbolt extender 2 has been cocked and door 3 closed to release Y stem 23. FIG. 1 is a side isometric view of a deadbolt extender in the cocked configuration. Tongue body 10 with tongue 12 attached is maintained in the cocked position by tongue stem 14 disposed in Y cradle 19. Y 20 is retained in the cocked position by virtue of hook 29 of catch 24 being engaged with Y stem 23. Catch 24 retains Y stem 23 against Y spring 22 and tongue body spring 18, as urged by tongue stem 14 in Y cradle 19.

Automatic Deadbolt Extension

Figure 2:
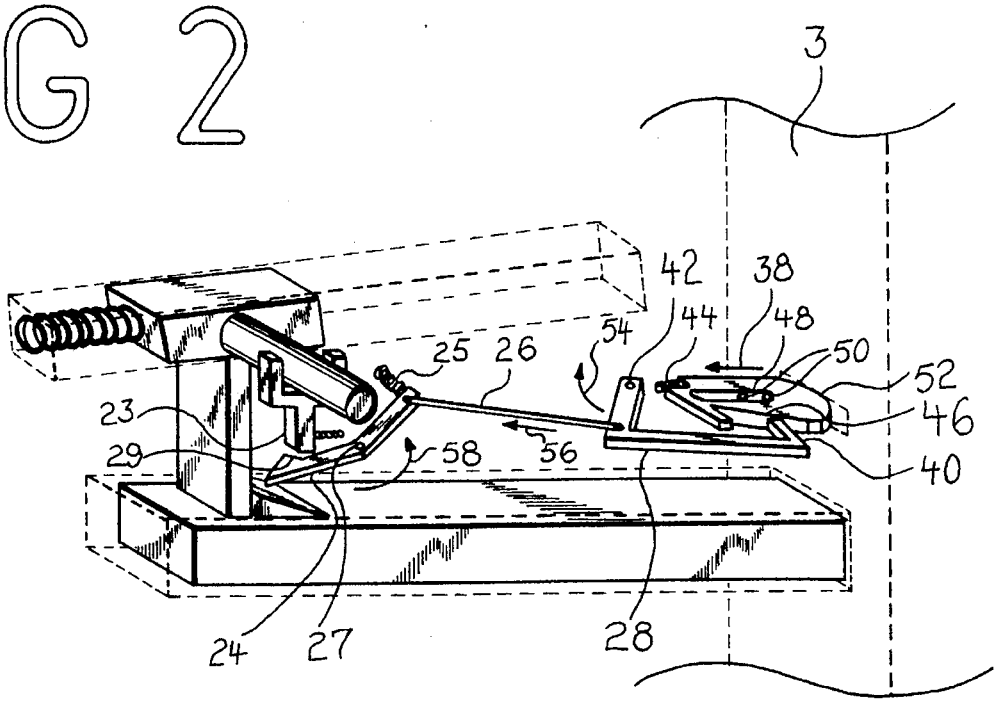
FIG. 2 is a side isometric view of a deadbolt extender which has just been released.

FIGS. 2–5 depict deadbolt extender 2 being released to automatically extend deadbolt 4 upon door closure. In FIG. 2, door 3 has just been closed. Strike plate 32 has pushed release 30 toward catch pivot point 27 against release spring 44, as indicated by arrow 38. Bellcrank feeler 40 has traveled over release ramp 46, thereby causing bellcrank 28 to rotate around bellcrank pivot point 42 against catch spring 25 as indicated by arrow 54. This rotation of bellcrank 28 causes pushrod 26 to translate as indicated by arrow 56, which causes catch 24 to rotate around catch pivot point 27 against catch spring 25 as indicated by arrow 58, until hook 29 disengages from Y stem 23.

Figure 3:
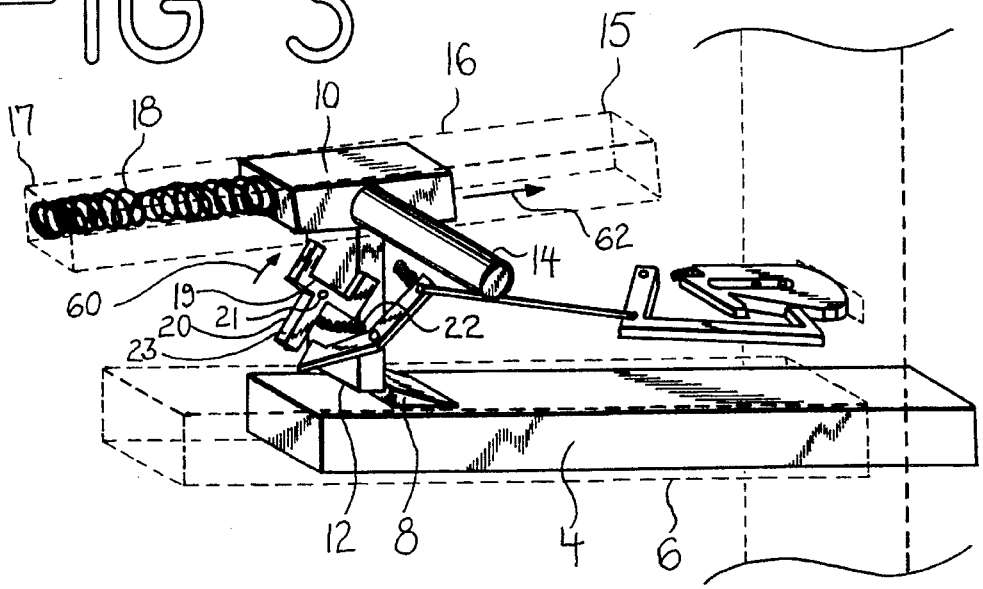
FIG. 3 is a side isometric view of a deadbolt extender at approximately half travel towards full deadbolt extension.

FIG. 3 is a side isometric view of a deadbolt extender at approximately half travel towards full deadbolt extension. After hook 29 has disengaged from Y stem 23, Y 20 is free to rotate, as urged by tongue body spring 18 pushing against tongue body 10 and tongue stem 14 in Y cradle 19, as indicated by arrow 60. FIG. 3 depicts Y 20 in the release position; tongue stem 14 has been released from Y cradle 19, freeing tongue body 10 with tongue 12 attached, to travel from spring end 17 to extension end 15 of tongue body track 16, as urged by tongue body spring 18.

Figure 4:
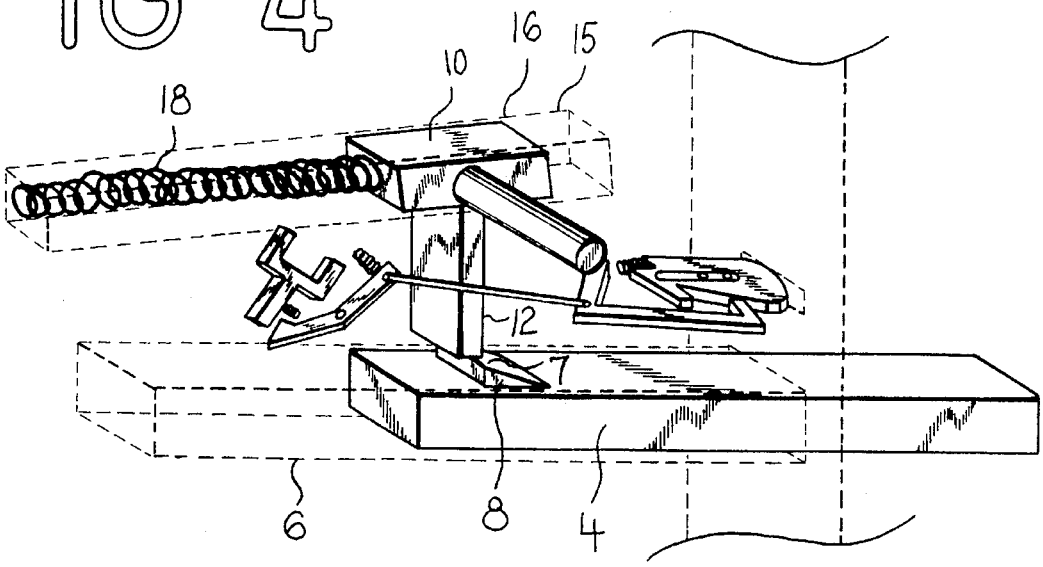
FIG. 4 is a side isometric view of a deadbolt extender whose tongue and deadbolt latch are at the tongue/latch disengage point.

As tongue 12 travels from spring end 17 to extension end 15 of tongue body track 16 as indicated by arrow 62, tongue 12 extends deadbolt 4 by pushing against deadbolt latch 8, as illustrated in FIG. 4. Tongue body track 16 spring end 17 is closer to deadbolt track 6 than tongue body track 16 extension end 15. Because tongue body track 16 diverges from deadbolt track 6, tongue 12 disengages from deadbolt latch 8 at tongue/latch disengage point 7. At tongue/latch disengage point 7, deadbolt 4 is fully extended, tongue 12 disengages from deadbolt latch 8, and tongue body 10 continues travel to extension end 15 as urged by tongue body spring 18. When tongue body 10 has traveled to extension end 15, tongue 12 is in the retracted position. When tongue 12 is in the retracted position, deadbolt 4 is free to extend and retract conventionally by means of a conventional deadbolt drive mechanism (not shown).

Figure 5:
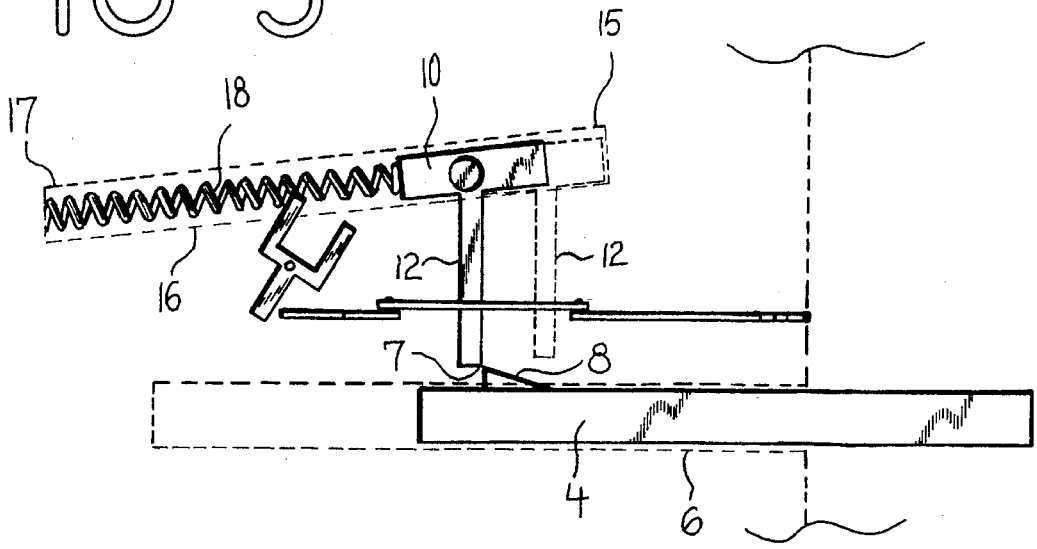
FIG. 5 is a side view of a deadbolt extender whose tongue and deadbolt latch are at the tongue/latch disengage point.

FIG. 4 is a side isometric view of a deadbolt extender whose tongue 12 and deadbolt latch 8 are at tongue/latch disengage point 7. FIG. 5 is a side view of a deadbolt extender whose tongue 12 and deadbolt latch 8 are at tongue/latch disengage point 7. The solid-lined tongue 12 and tongue body 10 are at tongue/latch disengage point 7. The dashed line tongue 12 and tongue body 10 are at extension end 15 of tongue body track 16.

Cocking the Deadbolt Extender

Figure 7:
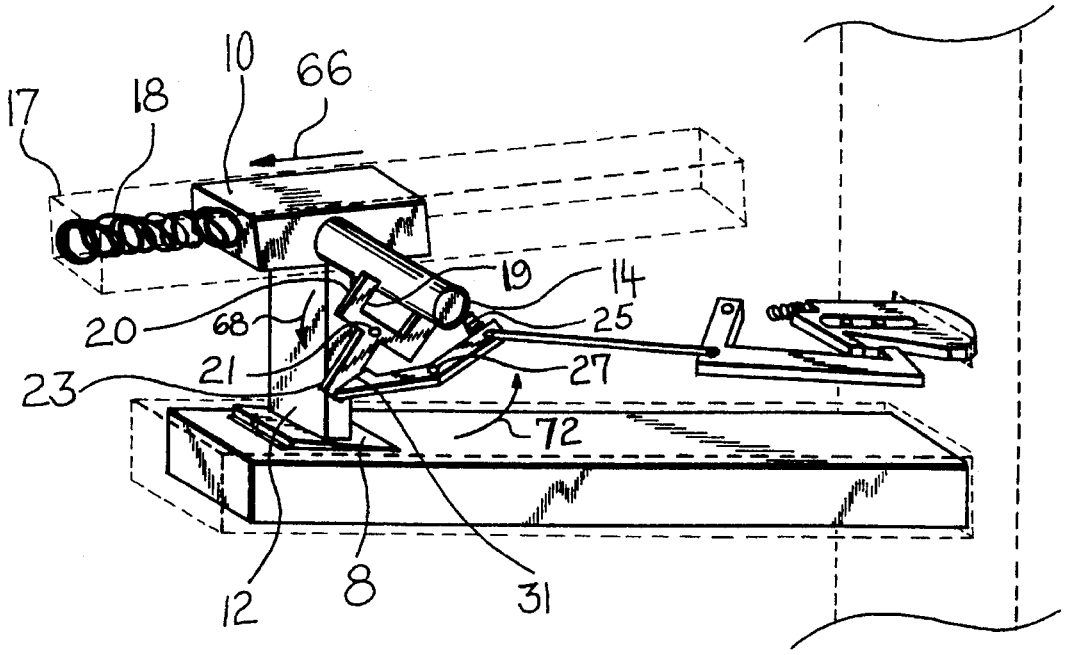
FIG. 7 is a side isometric view of a deadbolt extender whose tongue has traveled most of the way towards its cocked configuration position.

FIGS. 6, 7 and 1 illustrate the cocking operation necessary for deadbolt extender 2 to perform the automatic deadbolt extension function.

FIG. 6 is a side isometric view of a deadbolt extender whose tongue 12 is in the retracted position, and whose deadbolt 4 has been retracted via a conventional deadbolt drive mechanism. Deadbolt extender 2 is cocked with door 3 open, by pulling tongue stem 14 backwards to tongue body track 16 spring end 17 against tongue body spring 18.

Figure 8:
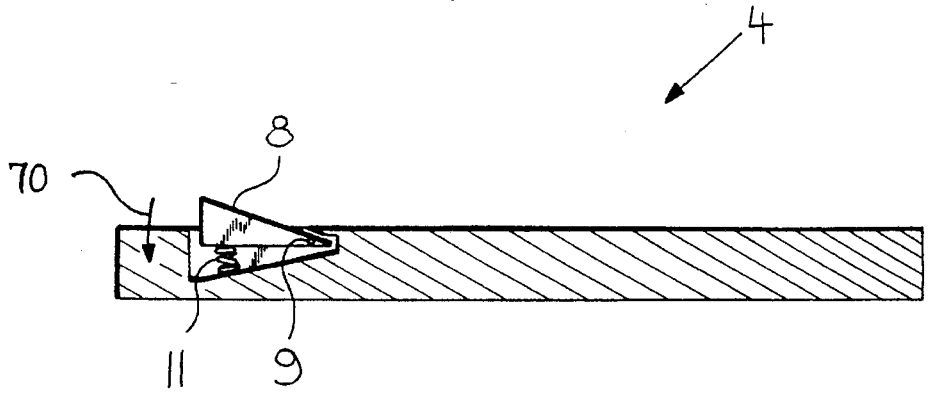
FIG. 8 is a cross sectional view of a deadbolt and spring-loaded deadbolt latch.

FIG. 7 is a side isometric view of a deadbolt extender whose tongue 12 has traveled most of the way towards its cocked configuration position in spring end 17, as indicated by arrow 66. Tongue stem 14 has started to engage Y cradle 19, causing it to rotate around Y pivot point 21 against Y spring 22, as indicated by arrow 68. As Y 20 rotates, Y stem 23 slides over catch cam 31, causing catch 24 to rotate about catch pivot point 27 against catch indicated by arrow 72. When deadbolt extender 2 is cocked, Y 20 is in the position illustrated in FIG. 1, and catch spring 25 urges hook 29 into releasable engagement with Y stem 23.

shown in FIG. 7, tongue 12 has depressed deadbolt latch 8 in order to pass over deadbolt latch 8 into its cocked position which is illustrated in FIG. 1. As illustrated in FIG. 8, deadbolt latch 8 rotates about deadbolt latch pivot point 9, and is spring-loaded away from deadbolt 4 by deadbolt latch spring 11. While deadbolt extender 2 is being cocked, tongue 12 slides over deadbolt latch 8, forcing it into a retracted position as indicated by arrow 70. After tongue 12 has passed over deadbolt latch 8 and into the cocked position, deadbolt latch 8 extends away from deadbolt 4 into the position illustrated in FIG. 8, ready to be engaged by tongue 12 to extend deadbolt 4 during the automatic extension operation.

FIG. 1 is a side isometric view of deadbolt extender 2 in the cocked configuration, ready to undertake the automatic deadbolt extension operation.

While a preferred embodiment of the invention has been illustrated herein, it is to be understood that changes and variations may be made by those skilled in the art without departing from the spirit of the appending claims.

| DRAWING ITEM INDEX |
|---|
| 2 deadbolt extender |
| 3 door |
| 4 deadbolt |
| 5 release mechanism |
| 6 deadbolt track |
| 7 tongue/latch disengage point |
| 8 deadbolt latch |
| 9 deadbolt latch pivot point |
| 10 tongue body |
| 11 deadbolt latch spring |
| 12 tongue |
| 14 tongue stem |
| 15 extension end |
| 16 tongue body track |
| 17 spring end |
| 18 tongue body spring |
| 19 Y cradle |
| 20 Y |
| 21 Y pivot point |
| 22 Y spring |
| 23 Y stem |
| 24 catch |
| 25 catch spring |

-continued

| DRAWING ITEM INDEX |
|---|
| 26 pushrod |
| 27 catch pivot point |
| 28 bellcrank |
| 29 hook |
| 30 release |
| 31 catch cam |
| 32 strike plate |
| 34 strike plate aperture |
| 36 door frame |
| 38 arrow |
| 40 bellcrank feeler |
| 42 bellcrank pivot point |
| 44 release spring |
| 46 release ramp |
| 48 release slot |
| 50 pins |
| 52 release cam |
| 54 arrow |
| 56 arrow |
| 58 arrow |
| 60 arrow |
| 62 arrow |
| 66 arrow |
| 68 arrow |
| 70 arrow |
| 72 arrow |

I claim:

1. A deadbolt extender comprising a tongue body track, a tongue body reciprocating within said tongue body track, a first means of urging said tongue body towards an extension end of said tongue body track, a tongue attached to said tongue body, a deadbolt, a deadbolt track, said tongue engaging said deadbolt, said deadbolt reciprocating within said deadbolt track, said tongue body track diverging from said deadbolt track whereby the divergence of said tongue body track from said deadbolt track causes said tongue to disengage from said deadbolt at a predetermined location along the length of said deadbolt track, and a release mechanism engaged with said tongue body whereby said tongue body may be releasably held against the influence of said first means.

2. A deadbolt extender comprising a tongue body reciprocating within a tongue body track, a first means of urging said tongue body towards an extension end of said tongue body track, a tongue attached to said tongue body, said tongue engaging a deadbolt reciprocating within a deadbolt track, said tongue body track diverging from said deadbolt track, and a release mechanism engaged with said tongue body whereby said tongue body may be releasably held against the influence of said first means, said release mechanism comprising a Y releasably engaged with said tongue body, a catch releasably engaged with said Y, a release sliding against a bellcrank, and a pushrod linking said catch and said bellcrank.

3. The deadbolt extender of claim 2 further comprising a tongue stem attached to said tongue body, and wherein said Y comprises a Y cradle, a Y stem, and a Y spring urging said Y stem away from said extension end, said Y rotating about a Y pivot point, and said catch being releasably engaged with said Y stem.

4. The deadbolt extender of claim 2 wherein said catch comprises a catch cam, a hook, and a catch spring, said catch rotates about a catch pivot point, and said catch spring urges said hook into releasable engagement with said Y.

5. The deadbolt extender of claim 2 wherein said bellcrank comprises a bellcrank feeler slidably engaged with said release, and said bellcrank rotates about a bellcrank pivot point.

6. The deadbolt extender of claim 2 wherein said release comprises a release cam, a release ramp, and a release spring, and a second means to constrain its motion to reciprocation, said release ramp being slidably engaged with said bellcrank.

7. The deadbolt extender of claim 6 wherein said release further comprises a release slot, and wherein said second means comprises pins slidably disposed within said release slot.

8. The deadbolt extender of claim 1 wherein said first means comprises a tongue body spring disposed in a spring end of said tongue body track.

9. The deadbolt extender of claim 1 wherein said deadbolt comprises a deadbolt latch in releasable engagement with said tongue.

10. The deadbolt extender of claim 9 wherein said deadbolt catch is spring-loaded away from said deadbolt into releasable engagement with said tongue.

11. A deadbolt extender comprising:

a tongue body reciprocating within a tongue body track:

a means of urging said tongue body towards an extension end of said tongue body track;

a deadbolt comprising a deadbolt latch reciprocating within a deadbolt track, a tongue attached to said tongue body, said tongue engaging said deadbolt latch said deadbolt track diverging from said tongue body track whereby the divergence of said tongue body track from said deadbolt track causes said tongue to disengage from said deadbolt at a predetermined location along the length of said deadbolt track;

a release mechanism engaged with said tongue body.

12. A deadbolt extender comprising:

a tongue body reciprocating within a tongue body track;

a means of urging said tongue body towards an extension end of said tongue body track comprising a tongue body spring disposed in a spring end of said tongue body track;

a deadbolt comprising a deadbolt latch reciprocating within a deadbolt track, said deadbolt track diverging from said tongue body track;

a tongue attached to said tongue body, said tongue engaging said deadbolt latch; and a release mechanism engaged with said tongue body.

* * * * *